US005360358A

United States Patent [19]

Haman

[11] Patent Number: 5,360,358

[45] Date of Patent: Nov. 1, 1994

[54] HIDDEN LOWER MOTOR COVER ATTACHMENT MEANS

[75] Inventor: David F. Haman, Waukegan, Ill.

[73] Assignee: Outboard Marine Corporation, Waukegan, Ill.

[21] Appl. No.: 65,993

[22] Filed: May 21, 1993

[51] Int. Cl.[5] ..... B63H 21/24

[52] U.S. Cl. ..... 440/77; 123/195 P

[58] Field of Search ..... 440/76–78, 440/88; 123/195 P

[56] References Cited

U.S. PATENT DOCUMENTS

| | | | |
|---|---|---|---|
| 3,933,114 | 1/1976 | Horn | 440/88 |
| 4,348,194 | 9/1982 | Walsh | 440/77 |
| 4,403,972 | 9/1983 | Bland et al. | 440/88 |
| 4,708,673 | 11/1987 | Dunham et al. | 440/77 |
| 5,055,074 | 10/1991 | Westberg et al. | 440/77 |
| 5,069,643 | 12/1991 | Westberg et al. | 440/77 |
| 5,096,208 | 3/1992 | Westberg | 440/77 |

*Primary Examiner*—Jesus D. Sotelo

*Attorney, Agent, or Firm*—Greer, Burns & Crain, Ltd.

[57] ABSTRACT

A lower motor cover attachment for an outboard motor includes a first lower motor cover half having an outer surface, an inner surface and an overboard water indicator opening, a second lower motor cover half having an outer surface and an inner surface, attachment formations located on respective inner surfaces of the first and second lower motor cover halves for use in releasably attaching the motor cover halves to the motor, and at least one fastener for engaging corresponding attachment formations and fastening the attachment formations of the first and second halves to the motor, wherein the overboard water indicator opening is disposed on the first lower motor cover so as to be substantially coaxial with at least one of the attachment formations, such that a tool inserted through the opening may engage the fastener in at least one of the attachment formations.

13 Claims, 1 Drawing Sheet 10
12
14
16
18
20
22
24
26
28
30
32
34
36
38
40
42
44
46
48
50
52
54
60
62
64
66
68
70
72
74
76
78
80
80F
80R
82
84
86
88
90
92
94
96
98
100

HIDDEN LOWER MOTOR COVER ATTACHMENT MEANS

BACKGROUND OF THE INVENTION

The present invention relates to outboard marine engines having split lower motor covers, and specifically to a lower motor cover attachment for an outboard motor which uses the overboard water indicator aperture as an access point for the disassembly of the lower motor covers.

One type of motor cowl construction commonly used on outboard marine engines includes a one-piece removable upper motor cover, and a pair of lower motor covers split along a vertical axis of the motor. The main advantage of the split lower motor covers is that the lower portion of the engine and the upper portion of the exhaust housing are easily accessible for maintenance and repair. In many cases, only two to four fasteners must be removed to disassemble the lower motor covers and obtain access to the engine.

One disadvantage of conventional split lower motor covers is that the fasteners used to secure the lower motor covers together are often visible from the outside of the motor, thus detracting from the otherwise streamlined appearance.

Another disadvantage of conventional split lower motor cover designs is that the fasteners securing the lower motor covers together are often placed in obscure locations which are difficult to access for removal, and as such, discourage the removal of the lower covers by service personnel, as well as by the owners of the motors. Thus, ironically, ease of maintenance, one of the major advantages of the split lower motor cover design, is often not realized in practice due to the inaccessible location of the lower motor cover fasteners.

It is therefore an object of the present invention to provide a lower motor cover attachment which is readily accessible for maintenance purposes.

Another object of the present invention is to provide a lower motor cover attachment which does not impair the outer aesthetic appearance of the outboard motor.

SUMMARY OF THE INVENTION

Accordingly, the above-identified objects are met or exceeded by providing a lower motor attachment configured so that the mounting hardware in the rear of the motor cover is accessible through the overboard water indicator opening. A hose normally located in the overboard water indicator opening is removed prior to the insertion of a tool through the opening for engaging a fastener which secures the two lower motor covers. The lower motor covers may be secured to each other, to the exhaust housing or to a panel bracket.

More specifically, a lower motor cover attachment for an outboard motor includes a first lower motor cover half having an outer surface, an inner surface and an overboard water indicator opening, and a second lower motor cover half having an outer surface and an inner surface. Attachment formations are located on respective inner surfaces of the first and second lower motor cover halves for use in releasably attaching the motor cover halves to the motor. Fasteners, preferably threaded fasteners, are provided for engaging a corresponding one of the attachment formations and fastening the attachment formations of the first and second halves to the motor. The attachment of the invention provides that the overboard water indicator opening is disposed on the first lower motor cover so as to be substantially coaxial with at least one of the attachment formations, such that a tool inserted through the opening may engage the fastener in at least one of the attachment formations. The attachment formations may be connected to each other, but would work equally well if attached to the power head, exhaust housing or a suitable mounting bracket.

In another embodiment, a lower motor cover attachment for an outboard motor having an upper motor cover includes a first lower motor cover half having an outer surface, an inner surface and an overboard water indicator opening, and a second lower motor cover half having an outer surface and an inner surface. Also included are attachment formations located on the first and second lower motor cover halves for use in releasably attaching the motor cover halves to the motor and fastening devices for engaging the attachment formations and fastening the attachment formations of the first and second halves to the motor. The attachment formations include boss formations disposed on an upper edge of at least one of the lower motor cover halves to be unobstructed and accessible upon removal of the upper motor cover.

DETAILED DESCRIPTION OF THE PREFERRED EMBODIMENT

Figures 1, 2:
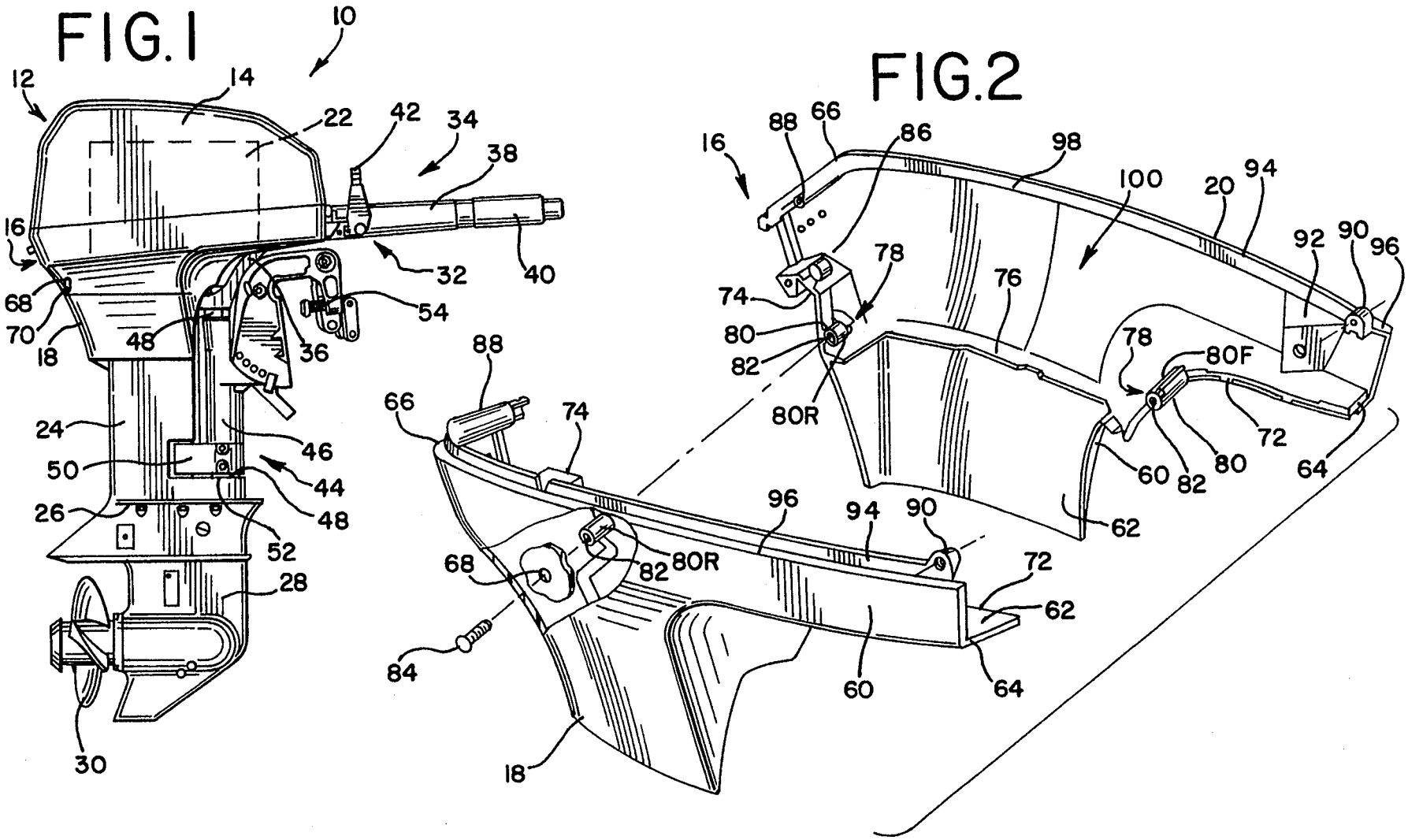
FIG. 1 is a side elevational view of an outboard motor of the type embodying the present lower motor cover attachment.
FIG. 2 is an exploded top perspective view of the lower motor cover attachment of the present invention, with portions shown cut away for clarity.

Referring now to FIG. 1, an outboard motor is shown and generally designated 10. The motor 10 is provided with a motor cowl 12 which includes an upper motor cover 14 and a lower motor cover 16, the lower motor cover being provided in two parts, a first cover portion 18 and a second cover portion 20 (best seen in FIG. 2). The first and second motor cover portions, 18, 20, are generally mirror images of each other and are configured to meet and partially enclose an internal combustion engine or power head 22 (shown hidden in FIG. 1).

The cover portions 18, 20 are preferably injection molded of a thermoplastic material; however, other molding processes are contemplated, including but not limited to sheet molding or die cast aluminum. The material used for the cover portions 18, 20 is preferably a rigid plastic.

An exhaust housing 24 depends from the engine 22 and is attached at a lower end 26 to a gear case housing 28. A propeller 30 is provided at a lower rear portion of the gear case housing 28 for propelling a boat through water, as is well known.

A steering handle assembly 32 is located at a front end 34 of the motor 10. The steering handle assembly 32 includes a steering arm or bracket 36, a tiller handle 38, an axially rotatable throttle grip 40, and a gear shift lever 42.

A stern bracket assembly 44 is provided with a vertical housing 46 including a shaft 48 axially disposed therein. A bracket 50 attached to the exhaust housing 24 surrounds the lower end of the housing 46. At a lower end, the shaft 48 engages the exhaust housing 24 at pivot point 52, and at an upper end, the shaft engages the steering arm 36. The stern bracket assembly 44 also includes at least one and preferably two threaded transom clamp members 54 for securing the bracket assembly 44 to the stern of a boat as is well known. The stern bracket assembly 44 permits the motor 10 to be pivotally controlled by the steering assembly 32 for steering purposes.

Referring now to both FIGS. 1 and 2, the lower motor cover 16 will be explained in greater detail. Each of the first and second cover portions 18, 20, which are generally configured to be mirror images of each other, include an outer wall surface 60, an inner wall surface 62, a front end 64 and a rear end 66. The first cover portion 18 is provided with an overboard water indicator opening 68, through which is passed an overboard water indicator hose 70 (best seen in FIG. 1). Overboard indicator hose 70 is connected to the cooling system of the motor 10, and when the power head 22 is running, the hose emits a stream of water to indicate to the operator that the water pump is operating correctly to properly cool the engine. Although the indicator opening 68 is preferably located on the first cover portion 18, it is contemplated that, depending on the application, the opening could easily be located on the second cover portion 20.

Each lower motor cover portion 18, 20 is also provided with a peripheral edge including a front edge portion 72 and a rear edge portion 74. Upon assembly of the lower motor cover 16 to the motor 10, the respective opposing rear edge portions 74 of the lower motor cover portions 18, 20 will be placed in contact with each other. The inner wall surfaces 62 of each lower motor cover portion 18, 20 are preferably provided with at least one laterally projecting formation 76 for engaging the exhaust housing 24, either directly, or indirectly through an intervening panel bracket (not shown). In addition, the opposing front edge portions 72 each engage a corresponding side of the intervening bracket.

The lower motor cover 16 is also provided, on each lower motor cover portion 18, 20 with at least one attachment formation 78, which in the preferred embodiment is formed as opposed, coaxial pairs of integral bosses 80 having threaded bores 82. In the preferred embodiment, there are a pair of main front bosses 80F on the front edge portion 72 and a pair of main rear bosses 80R on the rear edge portion 74, one such boss on each cover portion 18, 20, with the corresponding bosses of the respective cover portions being in opposing, coaxial relation with each other. Each boss 80 is configured to accept a threaded fastener, designated 84, which is inserted through a corresponding bore 82. The bores 82 may be internally threaded or in the preferred embodiment, are provided with captured threaded nuts (not shown). In the preferred embodiment, the fasteners 84 are screws having TORX heads, however, other types of fasteners 84 are contemplated including, but not limited to, machine screws and nuts.

At the rear end 66 of each of the lower motor cover portions 18, 20 is located a latch formation 86 configured for the attachment of a latch (not shown) for releasably securing the upper motor cover 14 to the lower motor cover 16. Also, each rear end 66 is provided with a boss formation 88 dimensioned and configured to be coaxially opposed to a like formation on the opposing lower motor cover portion. A suitable fastener 84, such as a threaded fastener and nut combination is used to secure the boss formations 88 to each other.

In the front of each lower motor cover portion 18, 20 is a mounting boss 90 which, along with the bosses 80F, are secured to the panel bracket (not shown) with threaded fasteners 84. In the preferred embodiment, the fastener 84 in the boss 80F is visible from the outside of the motor 10. The second motor cover portion 20 also may be provided with at least one access formation 92 to be used as an optional location for a fuel connection (not shown).

The engagement of the threaded fasteners 84 in each of the bosses 80F, 80R, 88 and 90 is the mechanism for holding the lower motor cover portions 18, 20 to the motor 10. Upon removal of the fasteners 84, the lower motor cover portions 18, 20 may be removed from the motor 10 to provide access to the engine 22 or other internal components of the motor 10 for repair purposes.

An important feature of the present invention is that the bosses 88 and 90 are located in a slightly recessed position on upper edges of the lower motor cover portions 18 and 20. Specifically, the bosses 88, 90 are located on, and form a portion of, an inner edge 94 of a shoulder 96 upon which rests the upper motor cover 14. Thus, the bosses 88, 90 are hidden when the upper motor cover 14 is in place. Upon removal of the upper motor cover 14, the bosses 88 and 90 are unobstructed and readily accessible. In fact, the bosses 88, 90 are accessible by an axially disposed tool such as a screwdriver (not shown) which was not possible in prior art lower motor cover attachments due to obscure locations of the mounting bosses.

In some conventional outboard motors employing split lower motor covers, at least one of the fasteners used to attach the covers to each other is accessible from the outside, and thus detracts from an unobstructed, streamlined appearance of the motor cover which is desired by contemporary outboard motor designers. To remove the unsightly appearance of at least one of these fasteners from the outside of the motor, in the present invention, the overboard water indicator opening 68 is disposed in a substantially coaxial position relative to the rear bosses 80R. In this manner, the corresponding fastener 84 is accessible by a screwdriver or appropriate tool inserted into the overboard water indicator opening 68. Naturally, the overboard water indicator hose 70 must be removed prior to removing the fastener. Also, the overboard water indicator opening 68 is dimensioned to accommodate the shaft of a screwdriver or appropriate tool (not shown).

In operation, when the lower motor cover 16 is to be removed, the upper motor cover 14 is first unlatched and removed from the motor 10. Next, the overboard water indicator hose 70 is pulled from the overboard water indicator opening 68 from the inner wall surface 62 and through the now open upper end 98 of engine compartment 100 defined in part by the lower motor cover 16. A screwdriver or appropriate tool (not shown) is then inserted into the opening 68 and engages the fastener 84. Upon the removal of the fasteners 84 from the bosses 88 and 80R, the rear end 66 of the lower motor cover portions are detached from each other. Next, removal of the fasteners 84 securing the bosses 80F and 90 releases the front end 64 of the lower motor cover portions 18, 20 from the motor 10.

Thus, the present lower motor cover attachment features a more aesthetically pleasing outer configuration of the motor cover 14, 16. In addition, the present attachment facilitates maintenance of the power head 22 by simplifying the access to the lower motor cover attachment fasteners 84.

While a particular embodiment of the lower motor cover attachment for an outboard motor using the overboard water indicator of the invention has been shown and described, it will be appreciated by those skilled in the art that changes and modifications may be made thereto without departing from the invention in its broader aspects and as set forth in the following claims.

What is claimed is:

1. A lower motor cover attachment for an outboard motor, comprising:

a first lower motor cover half having an outer surface, an inner surface and an overboard water indicator opening;

a second lower motor cover half having an outer surface and an inner surface;

attachment means located on said respective inner surfaces of said first and second lower motor cover halves for use in releasably attaching said motor cover halves to the motor;

fastening means for engaging said attachment means and fastening said attachment means of said first and second halves to the motor; and said overboard water indicator opening being disposed on said first lower motor cover so as to be substantially coaxial with at least one of said attachment means, such that a tool inserted through said opening may engage said fastening means located in said at least one of said attachment means.

2. The attachment as defined in claim 1 wherein said first and second lower motor cover halves are substantially mirror images of each other.

3. The attachment as defined in claim 1 wherein said attachment means includes a plurality of bored mounting bosses located on said first and second motor cover halves in opposing coaxial relationship to each other.

4. The attachment as defined in claim 1 wherein said attachment means includes front and rear pairs of opposing mounting bosses located on said first and second lower motor cover halves, said rear pairs of bosses being in contacting relationship with each other upon assembly.

5. The attachment as defined in claim 4 wherein said overboard water indicator opening is located coaxial with said rear mounting bosses.

6. The attachment as defined in claim 1 wherein said overboard water indicator opening is dimensioned to accommodate the shaft of a screwdriver.

7. The attachment as defined in claim 1 wherein said fastening means includes a threaded fastener for threadably engaging each of said attachment means for fastening to the motor said first and second lower motor cover halves.

8. A lower motor cover attachment for an outboard motor, comprising:

a first lower motor cover half having an outer surface, an inner surface and an overboard water indicator opening;

a second lower motor cover half having an outer surface and an inner surface;

at least one pair of opposing mounting bosses located on said respective inner surfaces of said first and second lower motor cover halves for use in releasably attaching said motor cover halves to the motor;

fastening means for engaging said mounting bosses and fastening said bosses of said first and second halves to the motor; and said overboard water indicator opening being disposed on said first lower motor cover so as to be substantially coaxial with one of the mounting bosses, such that a tool inserted through said opening may engage said fastening means in said at least one of said mounting bosses.

9. The attachment as defined in claim 8 wherein said fastening means located in said mounting boss which is coaxial with said overboard water indicator opening is not visible from said outer surface of the motor during normal operation of the motor.

10. A lower motor cover attachment for an outboard motor having an upper motor cover, comprising:

a first lower motor cover half having an outer surface, an inner surface, an upper edge and an overboard water indicator opening;

a second lower motor cover half having an outer surface, an inner surface and an upper edge;

attachment means located on said first and second lower motor cover halves for use in releasably attaching said motor cover halves to the motor; and fastening means for engaging said attachment means and fastening said attachment means of said first and second halves to the motor;

said attachment means include boss formations disposed in laterally recessed relationship on said upper edge of at least one of said lower motor cover halves to be unobstructed and accessible by axial insertion of a tool upon removal of the upper motor cover.

11. The attachment as defined in claim 10 further including front and rear boss formations located on an inner edge of a shoulder disposed on said upper edge of at least one of said lower motor cover halves.

12. The attachment as defined in claim 10 further including said overboard water indicator opening being disposed on said first lower motor cover so as to be substantially coaxial with at least one of said attachment means, such that a tool inserted through said opening may engage said fastening means located in said at least one of said attachment means.

13. A lower motor cover attachment for an outboard motor having an upper motor cover, comprising:

a first lower motor cover half having an outer surface, an inner surface and an overboard water indicator opening;

a second lower motor cover half having an outer surface and an inner surface;

attachment means located on said first and second lower motor cover halves for use in releasably attaching said motor cover halves to the motor; and fastening means for engaging said attachment means and fastening said attachment means of said first and second halves to the motor;

said attachment means include boss formations disposed on an upper edge of at least one of said lower motor cover halves to be unobstructed and accessible upon removal of the upper motor cover; and said overboard water indicator opening being disposed on said first lower motor cover so as to be substantially coaxial with at least one of said attachment means, such that a tool inserted through said opening may engage said fastening means located in said at least one of said attachment means.

* * * * *